US005605034A

United States Patent [19]

South et al.

[11] Patent Number: 5,605,034

[45] Date of Patent: Feb. 25, 1997

[54] SAND-TRAP RAKE WITH AN EXTRUDED HEAD

[75] Inventors: Robert E. South; Steven J. Petty, both of Warsaw, Ind.

[73] Assignee: Midwest Rake Co., Winona Lake, Ind.

[21] Appl. No.: 433,775

[22] Filed: May 3, 1995

Related U.S. Application Data

[63] Continuation-in-part of Ser. No. 379,070, Jan. 27, 1995, Pat. No. 5,544,476.

[51] Int. Cl.[6] ..... A01D 7/06

[52] U.S. Cl. ..... 56/400.07; 56/400.21

[58] Field of Search ..... 56/400.21, 400.05, 56/400.07, 400.01; D8/13; 29/557, 558

[56] References Cited

U.S. PATENT DOCUMENTS 4,741,150 5/1988 Saksun ..... 56/400.21
5,179,825 1/1993 Griffiths et al. ..... 56/400.21 X
5,440,869 8/1995 Meehan ..... 56/400.21

FOREIGN PATENT DOCUMENTS 0130766 2/1951 Sweden ..... 56/400.01

*Primary Examiner*—Terry Lee Melius
*Attorney, Agent, or Firm*—Wendell E. Miller

[57] ABSTRACT

A rake (140) includes an elongated head (142) and an elongated handle (144). The elongated head (142) includes a white-metal extruded head blank (148) with a tooth-blanking flange (154) and a handle-attaching flange (158). A plurality of rake teeth (186) are blanked, or otherwise defined, in the tooth-blanking flange (154). A pair of identical handle-attaching brackets (202) each having both a semi-cylindrical portion (206) and a flange portion (208) are used to attach the elongated handle (144) to the elongated head (142). The elongated head (142) includes a lifting portion (162) that cooperates with the rake teeth (186) in a raking step, an ironing portion (166) that provides an ironing step, and a secondary smoothing portion (170) for use in a supplemental smoothing step.

25 Claims, 4 Drawing Sheets

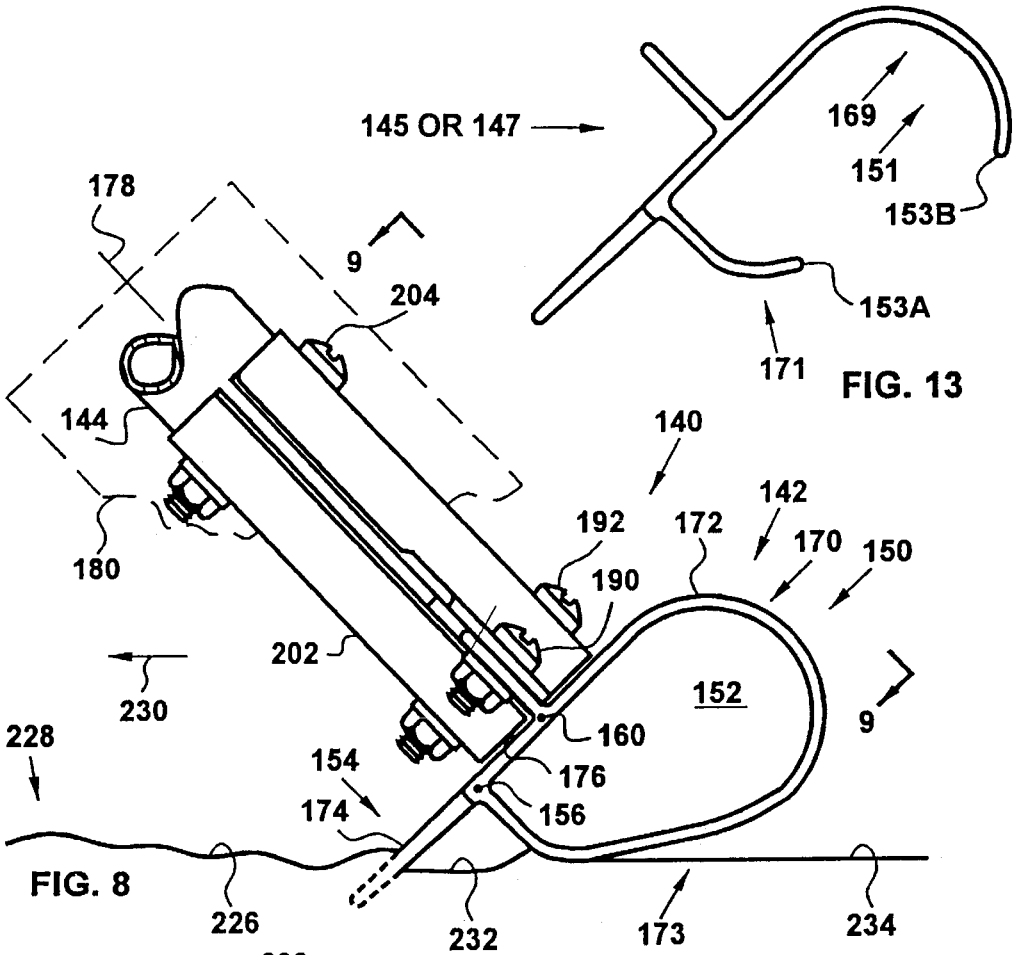
FIG. 13
FIG. 8
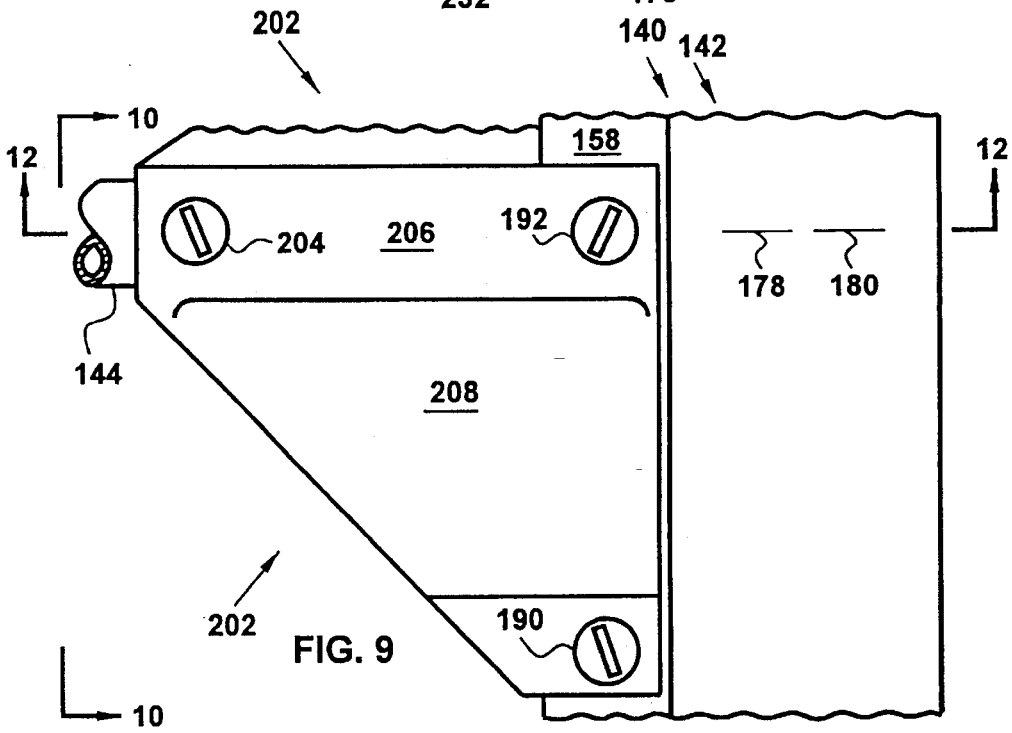
FIG. 9

SAND-TRAP RAKE WITH AN EXTRUDED HEAD

This patent application is a Continuation-in-Part of U.S. patent application Ser. No. 08/379,070, filed 27 January 1995, now U.S. Pat. No. 5,544,476.

BACKGROUND OF THE INVENTION

The present invention relates generally to tools and methods for attaching actuators, or handles, to tools. More particularly, the present invention relates to rakes for smoothing sand surfaces in the sand traps of golf courses and attaching handles to the heads thereof.

FIELD OF THE INVENTION

To meet the challenge of the sport, golfers go to great lengths to pare their scores as close to par as they are able. With this in mind, it is easy to see that removing footprints from the sand, and otherwise preparing the surface of the sand in a sand trap, becomes as important as choosing the correct iron that will be used to drive the ball from the sand trap.

SUMMARY OF THE INVENTION

A rake for smoothing sand-trap surfaces in response to pulling the rake along a longitudinal axis includes: an elongated head that is disposed transversely to tile longitudinal axis, a handle that is disposed along the longitudinal axis, and pluralities of blades or teeth.

In one embodiment, a first plurality of blades is disposed at one angle with respect to the longitudinal axis, and a second plurality of blades is disposed at the opposite angle, so that the first plurality of blades moves sand inwardly from one end of the elongated head, and the other plurality of blades move sand inwardly from the other end of the elongated head.

In another embodiment, an elongated head is made from a white-metal extrusion. The extrusion includes a shaped wall that encloses an opening, a tooth-blanking portion that extends outwardly from a first portion of the shaped wall, and a handle-attaching portion that extends outwardly from a different portion of the shaped wall.

The shaped wall includes a lifting portion that lifts the rake above a surface of the sand, an ironing portion that irons the surface of the sand subsequent to a raking step, and a secondary smoothing portion. The secondary smoothing portion is disposed above the handle, and the rake is turned with the teeth pointing upwardly to use the secondary smoothing portion.

A pair of brackets each include a semi-cylindrical portion and a flange portion. The semi-cylindrical portions cooperate to enclose and clamp onto the handle of the rake, and the flange portions bolt to the handle-attaching flange of the extruded head.

In a first aspect of the present invention, a method is provided for making a rake, which method comprises: extruding a white-metal extrusion that includes a shaped wall, a tooth-blanking flange extending outwardly from a first portion of the shaped wall, and a handle-attaching flange extending outwardly from a second portion of the shaped wall; severing an elongated head blank from the extrusion; defining a plurality of rake teeth in the tooth-blanking flange of the elongated head blank; and attaching an elongated handle to the handle-attaching flange.

In a second aspect of the present invention, a rake is provided which comprises an elongated head a handle, and means for attaching the head to the handle, the improvement which is characterized by the elongated head including a white-metal extruded head blank with a shaped wall a tooth-blanking flange that extends outwardly from a first arcuate portion of the shaped wall, a handle-attaching flange that extends outwardly from a second arcuate portion of the shaped wall, and a plurality of rake teeth being defined in the tooth-blanking flange; and the means for attaching the head to the handle comprises a pair of handle-attaching brackets each having both a shaped clamping portion and a flange portion.

In a third aspect of the present invention, a white-metal extrusion is provided for making an elongated head for a rake, which extrusion comprises a shaped wall; a tooth-blanking flange that extends outwardly from a first arcuate portion of the shaped wall; a handle-attaching flange that extends outwardly from a second arcuate portion of the shaped wall; a lifting portion of the shaped wall that is disposed proximal to the tooth-blanking flange and distal from the handle-attaching flange; an ironing portion of the shaped wall that is disposed proximal to the lifting portion and distal from the tooth-blanking flange; and a secondary smoothing portion of the shaped wall that is disposed proximal to tile handle-attaching flange and distal from the lifting portion.

In a fifth aspect of the present invention, a rake is provided which comprises an elongated head, a handle, and means for attaching the head to the handle, the improvement which is characterized by means, including a white-metal extrusion, for providing a white-metal extruded blank with a shaped wall, a tooth-blanking flange that extends outwardly from a first arcuate portion of the shaped wall, a handle-attaching flange that extends outwardly from a second arcuate portion or the shaped wall, and a plurality of rake teeth being defined in the tooth-blanking flange; and the means for attaching the head to the handle includes means, including a pair of handle-attaching brackets each having both a shaped clamping portion and a flange portion, for clamping to both the handle and the elongated head.

BRIEF DESCRIPTION OF THE DRAWINGS

FIG. 8 is a partial side view of a second embodiment of the sand-trap rake;

FIG. 9 is a partial top view of the sand-trap rake of FIG. 8, taken substantially as shown by view line 9—9 of FIG. 8, and showing the brackets that attach the handle to the handle-attaching flange of the elongated head;

FIG. 13 is an end view similar to FIG. 11, but rotated to the orientation of FIG. 8, illustrating both an end view of an alternate white-metal extrusion and an end view of an alternate elongated head blank that becomes an elongated head after blanking teeth in the blanking flange thereof.

DESCRIPTION OF THE PREFERRED EMBODIMENTS

Figure 1:
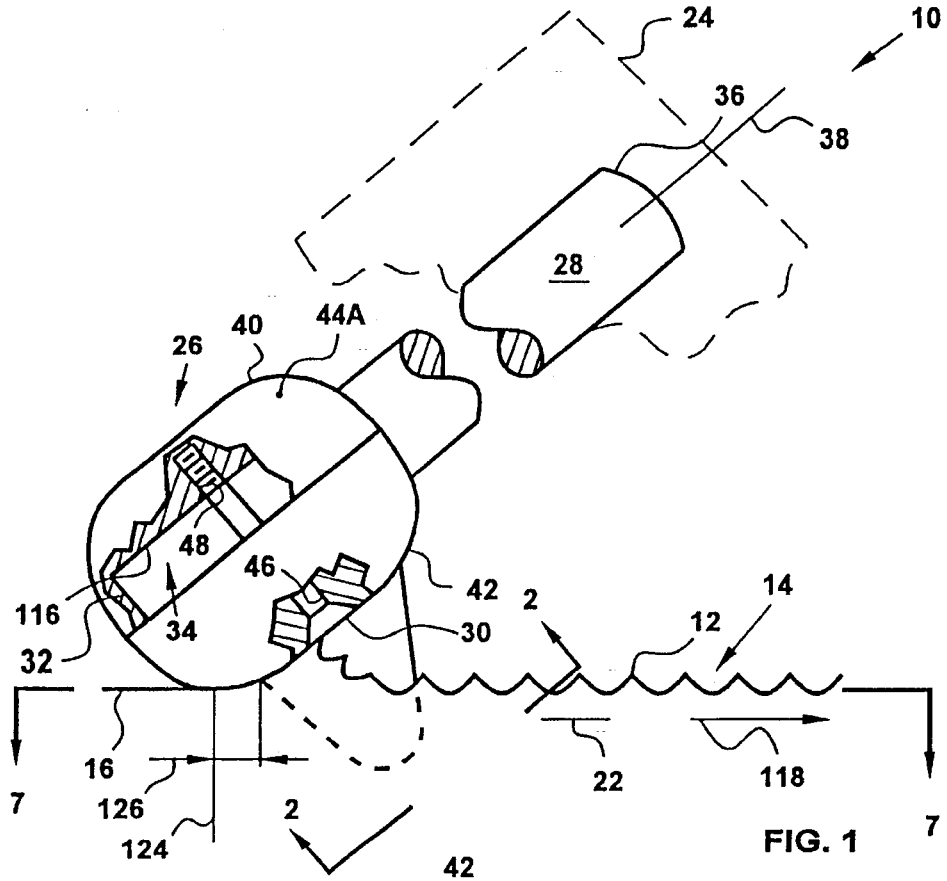
FIG. 1 is a side elevation of a first embodiment of the sand-trap rake of the present invention, with a handle inserted between elongated top and bottom portions, with partial cross-sections showing assembly details, and with surfaces of the sand, both raked and unraked, shown.
Figure 7:
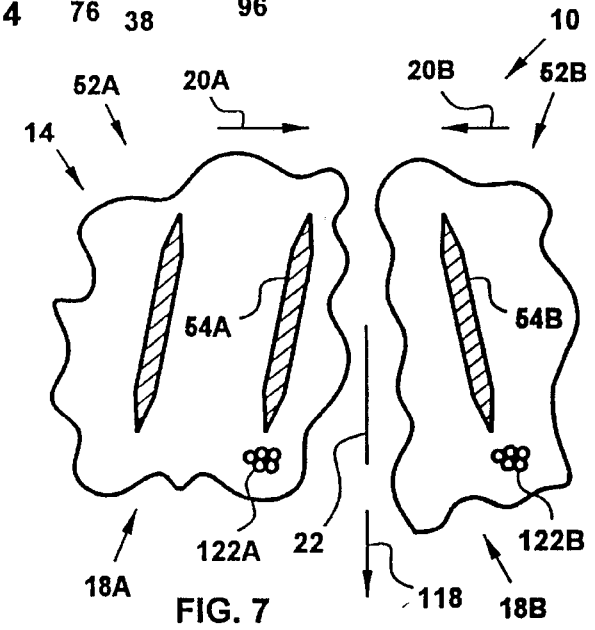
FIG. 7 is a top view, taken substantially as shown by view line 7—7 of FIG. 1, but rotated from standard position, showing sand being moved transversely inward from ends of the rake.

Referring now to FIGS. 1 and 7, a sand-trap rake 10 smooths an irregular surface, or roughened surface, 12 of a sand trap 14 into a smoothed and contiguous sand surface 16. This smoothing of the irregular surface 12 includes moving a first sand surface 18A in a first transverse direction 20A, and moving a second sand surface 18B in a second transverse direction 20B, as shown in FIG. 7, in response to pulling the rake 10 along a longitudinal axis 22 that is disposed in a vertical plane 24.

Continuing to refer to FIG. 1, the rake 10 includes an elongated head 26, a handle 28, and a self-tapping screw 30.

A first end 32 of the handle 28 is disposed in a handle opening 34 of the elongated head 26, and a second end 36 of the handle 28 is disposed distal from the handle opening 34. Both the handle 28 and the handle opening 34 are disposed along a handle axis, or handle opening axis, 38 that is in the vertical plane 24. In normal use, depending somewhat upon the height of the user, the handle axis 38 is disposed about 40 degrees above the longitudinal axis 22.

Figure 2:
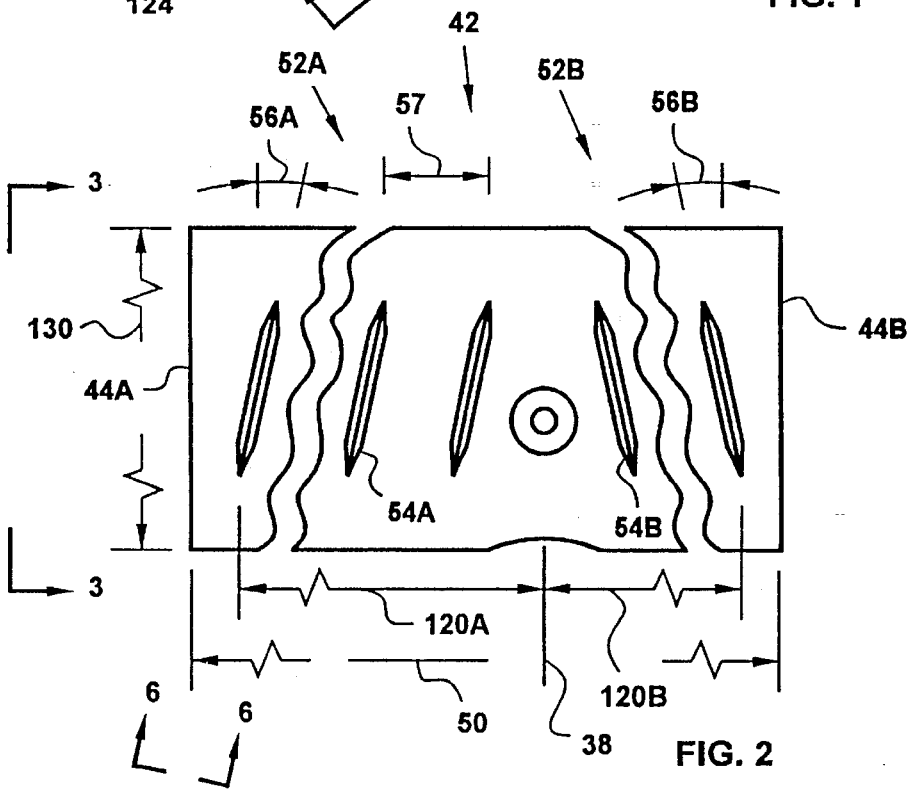
FIG. 2 is a bottom view of tile bottom portion of the rake of FIG. 1, taken substantially as shown by view line 2—2 of FIG. 1, bill rotated from standard position, showing first and second pluralities of teeth disposed on opposite sides of a longitudinal axis and disposed at opposite angles with respect to the longitudinal axis.
Figure 3:
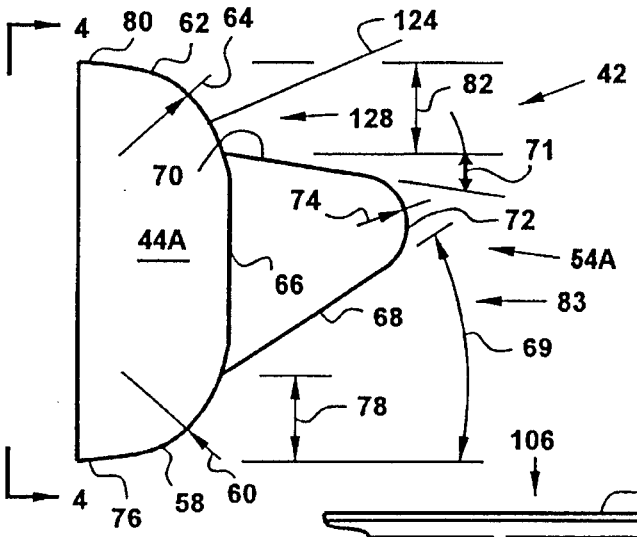
FIG. 3 is an end view of the bottom portion of FIG. 2, taken substantially as shown by view line 3—3 of FIG. 2.

Referring now to FIGS. 1–3, the elongated head 26 includes an elongated top portion 40 and an elongated bottom portion 42. The elongated head 26 includes first and second ends 44A and 44B, and the top and bottom portions, 40 and 42, include like-numbered ends.

Referring again to FIG. 1, the self-tapping screw 30 is inserted through a countersunk hole 46 in the elongated bottom portion 42, retainingly pierces the handle 28, and taps into a screw-starting hole 48 in the elongated top portion 40, thereby both securing the elongated top and bottom portions, 40 and 42, together, and securing the handle 28 in the handle opening 34.

Figure 4:
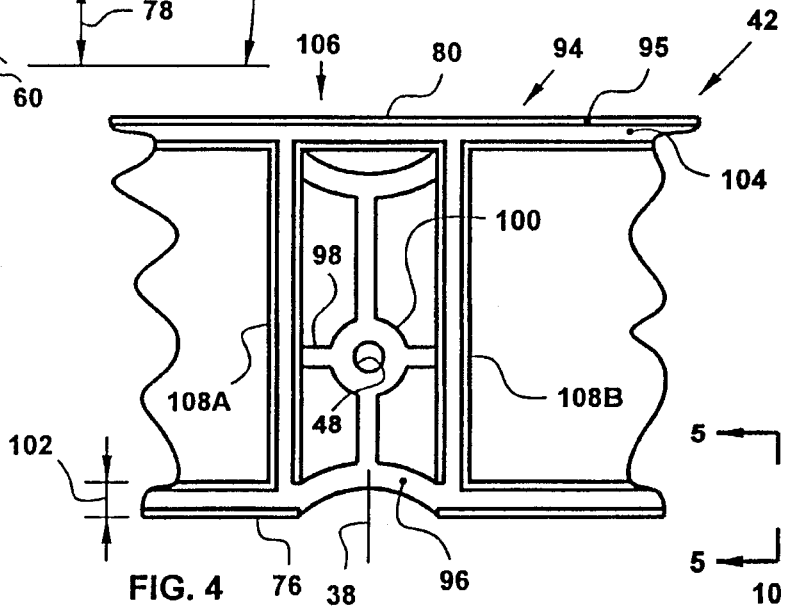
FIG. 4 is a partial plan view of the inside of the bottom portion of FIGS. 2 and 3, taken substantially as shown by view line 4—4 of FIG. 3, and showing handle-receiving details.

Referring now to FIGS. 1, 2, and 4 more particularly to FIG. 2, the elongated bottom portion 42 includes an elongated dimension 50 that extends between the ends 44A and 44A, and the ends 44A and 44B are equidistant from tile longitudinal axis 22, the handle axis 38, and the vertical plane 24.

A first plurality 52A of individual teeth, or blades, 54A are disposed at a first angle 56A with respect to the handle axis 38 and the vertical plane 24, and a second plurality 52B of individual teeth, or blades, 54B are disposed at a second, opposite, and substantially equal angle 56B. Each of the blades 54A or 54B are spaced from each other at a distance 57.

Referring now to FIG. 3, the elongated bottom portion 42 includes a first curvilinear surface, or front curvilinear surface, 58 having a front radius 60, a second curvilinear surface, or rear curvilinear surface, 62 having a rear radius 64, and a flattened portion 66 that is disposed between the curvilinear surfaces 58 and 62.

The teeth, or blades, 54A and 54B, each include a leading edge 68 that is tapered at a first angle 69, a trailing edge 70 that is tapered at a smaller angle 71, and a curved end 72 having a radius 74. The leading edges 68 of the blades 54A and 54B are set back from an elongated front edge 76 of the elongated bottom portion 42 by a dimension 78, and the trailing edges 70 of the blades 54A and 54B are disposed in front of an elongated rear edge 80 of the elongated bottom portion 42 by a dimension 82. The first curvilinear surface 58, the second curvilinear surface 62, and the flattened portion 66 combine to form a curvilinear bottom surface 83 that extends between the ends 44A and 44B and curves convexly with respect to the front 76 and rear 80 edges.

Figure 6:
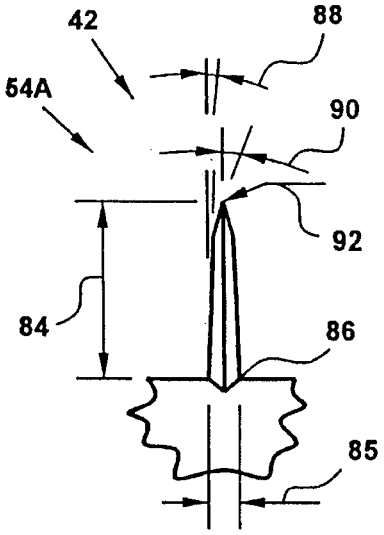
FIG. 6 is an edge profile of a tooth taken substantially as shown by view line 6—6 of FIG. 2.

Referring now to FIG. 6, the blade 54A includes a height 84, a width, or thickness, 85 at a base 86, a draft angle 88, a sharpening angle 90, and a tip and edge radius 92. The tip and edge radius 92 extends along the leading edge 68, the curved end 72, and the trailing edge 70 of FIG. 3. The blade 54B includes like-named, like-numbered, and like-dimensioned parts as the blade 54A.

Although in FIG. 3 the blade 54A is not shown at an angle to the plane of the paper, dimensions as included herein pertain to true profiles of the individual teeth 54A and 54B.

Referring now to FIG. 4, the elongated bottom portion 42 includes a peripheral flange 94 with a top joining surface, or elongated joining surface, 95, and a semi-cylindrical surface, or semi-cylindrical opening, or semi-cylindrical shape, 96. The semi-cylindrical surface 96 includes ribs 98, a screw-receiving boss 100, and the screw-starting hole 48. The peripheral flange 94 has a width 102, and extends along the front edge 76, the rear edge 80, and the first and second ends, 44A and 44B, of FIG. 2.

Figure 5:
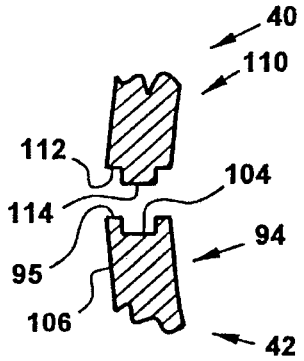
FIG. 5 is a partial cross section of the bottom and top portions, with the bottom portion taken substantially as shown by view line 5—5 of FIG. 4, and with the top portion taken substantially the same as the bottom portion, but separated therefrom.

Referring now to FIGS. 4 and 5, the peripheral flange 94 of the bottom portion 42 includes a tang-receiving groove 104 that is disposed inside a periphery 106 of the bottom portion 42, that extends around the periphery 106 except for the semi-cylindrical surface 96, and that extends along sides 108A and 108B of the semi-cylindrical surface 96.

Continuing to refer to FIG. 5, a matching peripheral flange 110 of the elongated top portion 40 of FIG. 1 includes a surface 112 with a tang 114 that matches the tang-receiving groove 104 of the bottom portion 42. As seen only in FIG. 1, the elongated top portion 40 includes a semi-cylindrical surface, or semi-cylindrical opening, 116; so that the semi-cylindrical surfaces 96 of FIG. 4 and 116 of FIG. 1 combine to form tile handle opening 34.

The tang 114 and the tang-receiving groove 104 cooperate to prevent all transverse movement between the elongated top portion 40 and the elongated bottom portion 42.

Referring now to FIGS. 1 and 7, and more particularly to FIG. 7, with the rake 10 being drawn along the longitudinal axis 22 in a pulling direction 118 by the handle 28, the first plurality 52A of the blades 54A move the first sand surface 18A transversely inward in tile first direction 20A, from the end 44A of FIG. 2 toward both the longitudinal axis 22 and the handle axis 38 of FIG. 1, and the second plurality 52B of the blades 54B, move the second sand surface 18B transversely inward in the second direction 20B, from the end 44B of FIG. 2 toward the longitudinal axis 22 and the handle axis 38.

Referring again to FIGS. 1 and 3, the front curvilinear surface 58 and/or the flattened portion 66 provide(s) lifting means for lifting the rake 10 as the elongated head 26 encounters the roughened surface 12. That is depending upon the height of the user and the angle between the handle axis 38 and the longitudinal axis 22, the front curvilinear surface 58 and/or the flattened portion 66 provide(s) the lifting means.

The rear curvilinear surface 62 provides an ironing function, ironing the sand surfaces 18A and 18B of FIG. 7 into the smoothed and contiguous sand surface 16 subsequent to a step in which the pluralities 52A and 52B of the teeth 54A and 54B move the sand surfaces 18A and 18B transversely inward.

Referring to FIGS. 1, 2, and 7, the method of the present invention includes simultaneously raking a first longitudinally-extending width, or first longitudinally-disposed portion, 120A and a second, or adjacent, longitudinally-extending width, or second longitudinally-disposed portion, 120B of the first and second sand surfaces, 18A and 18B, moving grains 122A and 122B of sand from the sand surfaces 18A and 18B transversely toward each other, and ironing the sand surfaces 18A and 18B into the smoothed and contiguous sand surface 16. The method of the present invention further comprises lifting the elongated head 26 and floating the elongated head 26.

As seen in FIGS. 1, 3, and 7, for the ironing step, the principal line of contact of the rear curvilinear surface 62 is a line of contact 124 that is disposed rearward of the teeth 54A and 54B by a dimension 126. Therefore, in terms of methods steps, the ironing step follows the step of transversely moving the sand surfaces 18A and 18B inwardly.

The flattened portion 66, and/or a part 128 of the rear curvilinear surface 62 that lies between the flattened portion 66 and the line of contact 124, provide(s) float means for floating the elongated head 26.

In the embodiment as described above, the elongated head 26 is straight, as opposed to being curved or angled, extends transversely outward from the handle axis 38 at an angle of 90 degrees, and has an elongated head width 130. Preferably, the blades 54A and 54B are straight, but disposed at the angles, 56A and 56B of FIG. 2. Preferably, both of the pluralities 52A and 52B of the blades 54A and 54B, are disposed to move the sand surfaces 18A and 18B inwardly. And, preferably, the angles 56A and 56B of the blades 54A and 54B are equal for each of the blades 54A and 54B.

For purposes of understanding the claims, where an order of sequence is recited, the recited order is the same as any continuous process. That is, the step of floating precedes the step of ironing for the longitudinally-disposed portions 120A and 120B of the sand surfaces 18A and 18B. More importantly, the step of ironing follows the steps of moving the sand surfaces 18A and 18B transversely inward.

However, as can be seen by inspection of FIG. 1, the transversely moving steps, as achieved by the teeth 54A and 54B, are substantially concurrent with the floating step that is achieved, at least in part, by the flattened portion 66.

The blades 54A and 54B, and the angles 56A and 56B, thereof of FIG. 2, provide means for moving the grains 122A and 122B of sand in the first and second transverse directions, 20A and 20B, in response to movement of the rake 10 along the longitudinal axis 22. Preferably, the directions 20A and 20B of transverse movement are inwardly of the ends 44A and 44B of FIG. 2, toward the longitudinal axis 22.

Further, referring to FIGS. 1–3, the means for moving the grains 122A and 122B of sand of FIG. 7 transversely includes the trailing edges 70 of the blades 54A and 54B being disposed at different distances from the ends 44A and 44B of the elongated head 26, than the leading edges 68 thereof.

Preferably, the trailing edges 70 are closer to the longitudinal axis 22 than the leading edges 68, so that the longitudinally-disposed portions, 120A and 120B, of FIG. 2, of the sand surfaces 18A and 18B of FIG. 7, are moved transversely inward toward the longitudinal axis 22.

Figure 10:
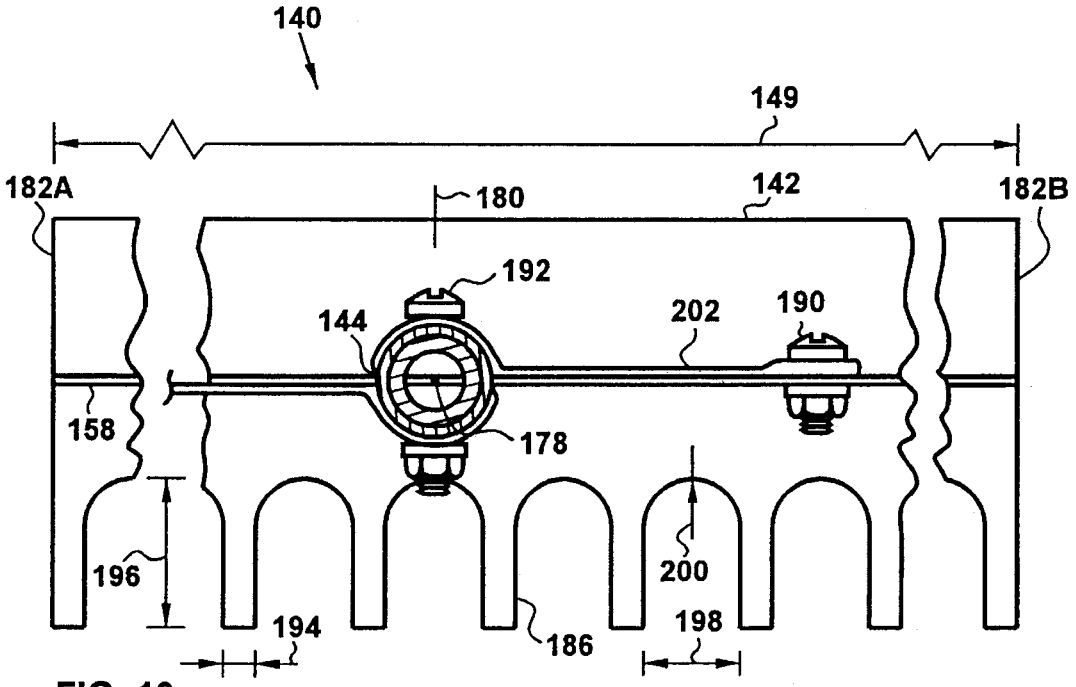
FIG. 10 is an end view of the sand-trap rake of FIGS. 8 and 9, taken substantially as shown by view Line 10—10 of FIG. 9, and showing the brackets that attach the handle to the handle-attaching flange of the elongated head.

Referring now to FIGS. 8–10, in a second embodiment, a tool, or sand-trap rake, 140 includes a tool head, or transversely-disposed and elongated head, 142, an actuator, or elongated handle, 144, and means, which will be described subsequently, for attaching the elongated handle 144 to the elongated head 142.

Figure 11:
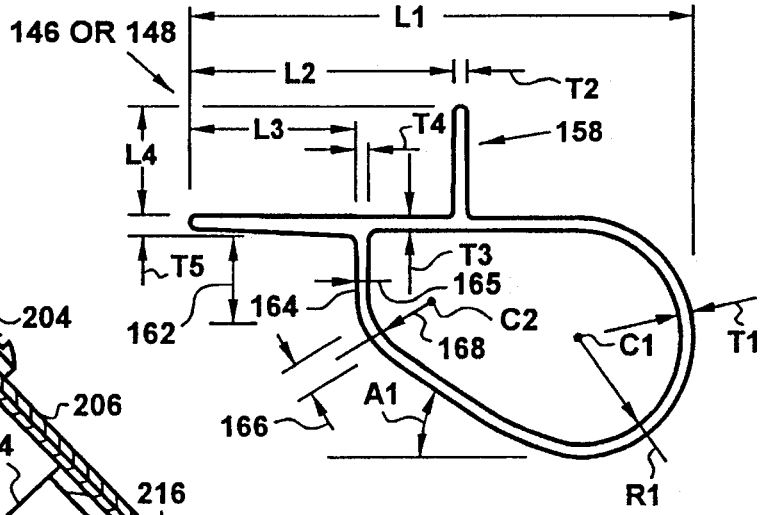
FIG. 11 serves both as an end view of a white-metal extrusion and an end view of an elongated head blank that becomes an elongated head after blanking teeth in the blanking flange of the elongated head blank.

Referring now to FIGS. 8–12, and more particularly to FIG. 11, the elongated head 142 of FIGS. 8–10 is made from a white-metal extrusion 146 of FIG. 11. The extrusion 146 is preferably made from an aluminum alloy, generally designated as 6063-T6.

FIG. 11 represents both an end view of the white-metal extrusion 146 and an end view of an elongated head blank, or white-metal extruded head blank, 148 cut therefrom. The only difference between the extrusion 146 and the elongated head blank 148 is that the elongated head blank 148 is cut to a particular length, or elongated dimension, 149, as shown in FIG. 10, to make the elongated head 142.

However, in the following discussion, some features are described in conjunction with FIG. 8, and all of these features apply equally to both the white-metal extrusion 146 and the elongated head blank 148.

The white-metal extrusion 146 includes a shaped wall 150 that, preferably, circumscribes an opening 152, a tooth-blanking flange 154 that extends outwardly from a first arcuate portion 156 of the shaped wall 150, and an actuator-attaching flange, or elongated handle-attaching flange, 158 that extends outwardly from a second arcuate portion 160 of the shaped wall 150.

The shaped wall 150 includes a lifting portion 162 that is disposed proximal to the tooth-blanking flange 154 and distal from the handle-attaching flange 158. Preferably, the lifting portion 162 includes a surface 164 that is substantially planar, so that mathematically, although not shown, the surface 164 has a first radius of curvature 165 that is infinite.

The shaped wall 150 also includes an ironing portion 166 that is proximal to the lifting portion 164 and that is distal from the tooth-blanking flange 154. The ironing portion 166 has a radius of curvature 168 which is smaller than the radius of curvature 165 of the surface 164 of the lifting portion 162.

Figure 12:
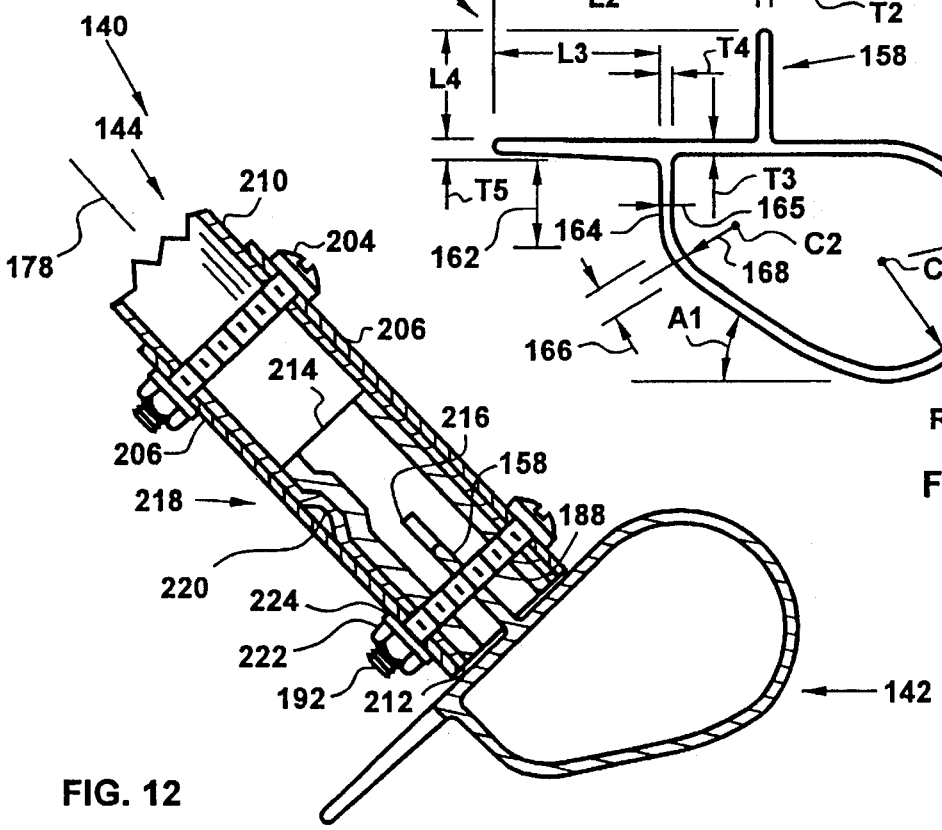
FIG. 12 is a cross-sectional end view of the sand-trap rake of FIGS. 8–10, taken substantially as shown by Section Line 11—11 of FIG. 9.

Finally, the shaped wall 150 includes a secondary smoothing portion 170 that is proximal to the handle-attaching flange 158 and distal from both the lifting portion 162 and the tooth-blanking flange 154. The secondary smoothing portion 170 includes a curved surface 172. As shown in FIGS. 8, 11, and 12, a connecting portion 173 that is planar connects the ironing portion 166 and the secondary smoothing portion 170.

In the preferred configuration, as shown in FIGS. 8 and 11, both the extrusion 146 and the elongated head blank 148 are further defined by: the tooth-blanking flange 154 having a substantially planar surface 174; the shaped wall 150 having a substantially planar surface 176 and coinciding with the tooth-blanking flange 154; and the tooth-blanking flange 154 being substantially orthogonal, that is, disposed at 90 degrees, to the handle-attaching flange 158. FIG. 13 represents both an end view of an alternate white-metal extrusion 145 and an end view of an alternate elongated head blank 147 cut therefrom.

Except as described in the next paragraph, both the white-metal extrusion 147 and the elongated head blank 149 are identical to the white-metal extrusion 146 and the elongated head blank 148 of FIG. 11. Therefore, the extrusions 146 and 147 and the head blanks 148 and 149 are like-numbered, like-named, and like-dimensioned, even though not all numbers, names, and dimensions are shown or described with respect to FIG. 13.

Whereas, as described above, the shaped wall of FIGS. 8 and 11 preferably closes upon itself to circumscribe the opening 152, in the alternate embodiment of FIG. 13, because of an arcuately-shortened secondary smoothing portion 169 and a narrow auxiliary portion 171, a shaped wall 151 includes open ends 153A and 153B.

Preferred dimensions for the extrusion 146 are: T1 equals 0.152 cm., T2 equals 0.305 cm., T3 equals 0.229 cm., T4 equals 0.229 cm., T5 equals 0.419 cm., a radius of curvature R1, which has a center C1, equals 2.223 cm., the radius of curvature 168, which has a center C2, equals 1.270 cm., A1 equals 40 degrees, L1 equals 8.890 cm., L2 equals 5.080 cm., L3 equals 3.175 cm., and L4 equals 2.540 cm.

Referring now to FIGS. 8–10, the elongated head 142 includes ends 182A and 182B which, in the preferred configuration, are equidistant from an axis 178 and a plane 180, and are spaced apart by the elongated dimension 149 that is equal to 56.896 cm.

Referring now to FIGS. 10–12, as shown in FIG. 10, the elongated head 142 of FIG. 10 is made by severing the elongated head blank 148 from the white-metal extrusion 146, blanking, or otherwise defining, a plurality of rake of teeth 186 into the tooth-blanking flange 154 of FIG. 8, and drilling holes 188, as shown in FIG. 12, through the handle-attaching flange 158 in locations as pictured by bolts 190 and 192.

The teeth 186 each have a width 194 and a length 196. A space 198 between the teeth 186 includes a radius 200. In the preferred embodiment the width 194 equals 0.533 cm., the length 196 equals 3.175 cm., and the radius 200 equals 1.588 cm.

Referring now to FIGS. 8–12, means for attaching the elongated handle 144 to the handle-attaching flange 1.58 includes a pair of actuator-attaching halves, handle-attaching brackets, or handle-clamping halves, 202 that are identical, two of the bolts 190, the bolt 192, and a bolt 204.

Each of the handle-clamping halves 202 is fabricated from a white-metal extrusion, and both the extrusion and the handle-clamping halves 202 include a shaped clamping portion, or semi-cylindrical handle-clamping portion 206 and a flange portion 208.

As is evident from the drawings and from the foregoing description, the extrusion from which the handle-clamping halves 202 are fabricated includes a continuous shaped portion, or semi-cylindrical portion, and a continuous flange portion.

The elongated handle 144 includes an aluminum tube 210 with an end 212, so that; the handle 144 also includes the end 212, a tubular bushing, or plug, 214, made of aluminum, that is inserted into the aluminum tube 210 and that is juxtaposed against the end 212, a slot 216 that extends longitudinally inward from the end 212, thereby providing a slotted portion 218 of the handle 144. The tubular bushing 214 is fixedly secured in the tube 210 by staked portions 220.

The shaped clamping portion 206 is shaped to clampingly engage the slotted portion 218 of the handle 144. Preferably, when the handle 144 is round at the slotted portion 218, the shaped clamping portion 206 is semi-cylindrical, as shown.

As shown in FIGS. 8–12, the end 212 of the elongated handle 144 is enclosed between pairs of the semi-cylindrical handle-clamping portions 206 with the slotted portion 218 straddling the handle-attaching flange 158 of the elongated head 142.

The bolts 190 clamp the flange portions 208 of the handle-attaching brackets 202 to the handle-attaching flange 158 of the elongated head 142. The bolt 192 extends through both of the semi-cylindrical portions 206 of the handle-attaching brackets 202, through the slotted portion 218 of the handle 144, and through the handle-attaching flange 158 of the elongated head 142. The bolt 204 extends through both of the semi-cylindrical portions 206 and through the aluminum tube 210. Nuts 222 and leek washers 224 are used with the bolts 190, 192, and 204 to complete attachment of the handle 144 to the elongated head 142.

The method for making the handle-clamping halves 202 includes the steps of: extruding the extrusion that includes both the shaped clamping portion, or semi-cylindrical handle-clamping portion, 206 and the flange portion 208, severing first and second longitudinal portions from the extrusion, and beveling the flange portions 208 of the severed first and second portions.

The method for making the sand-trap rake 140 includes the steps of: extruding the white-metal extrusion 146 that includes the shaped wall 150, the tooth-blanking flange 154 extending outwardly from the first portion 156 of the shaped wall 150, and the handle-attaching flange 158 extending outwardly from the second portion 160 of the shaped wall 150; severing the elongated head blank 148 from the extrusion 146; blanking the plurality of teeth 186 from the tooth-blanking flange 154 of the elongated head blank 148; and attaching the elongated handle 144 to the handle-attaching flange 158.

The extruding step further comprises forming the lifting portion 162 of the shaped wall 150, proximal to the tooth-blanking flange 154 and distal from the handle-attaching flange 158, that includes the first radius of curvature 165; forming the ironing portion 166 of the shaped wall 150, proximal to the lifting portion 162 and distal from the tooth-blanking flange 154, that has the smaller radius of curvature 168 than the first radius of curvature 165; and forming the secondary smoothing portion 170 of the shaped wall 150 proximal to the handle-attaching flange 158 and distal from both the lifting portion 162 and the tooth-blanking flange 154.

The attaching step includes forming a pair of the handle-clamping halves 202 that each include the semi-cylindrical handle-clamping portion 206 and the flange portion 208; disposing the flange portions 208 of the pair of handle-clamping halves 202 toward the opposite ends 182A and 182B of the head blank 148; reinforcing the aluminum tube 210 with the tubular bushing 214, slotting the end 212 of the aluminum tube 210 and the tubular bushing 214, thereby forming the elongated handle 144 with the slotted portion 218 juxtaposed to the end 212; straddling the handle-attaching flange 158 of the elongated head 142 with the slotted portion 218, enclosing the end 212 of the handle 144 between pairs of the semi-cylindrical portions 206; and using the bolt 192 not only to clamp the semi-cylindrical handle-clamping portions 206 to the slotted portion 218, but also to clamp the slotted portion 218 to the handle-attaching flange 158 of the elongated head 142.

Referring to FIGS. 8, 10, and 11, in use, the handle 144 is positioned approximately 41 degrees above art unraked surface 226 of sand 228, and the rake 140 is moved in a pulling direction 230 that is in the plane 180. The teeth 186 engage the unraked surface 226 producing a raked surface 232, with the lifting portion 162 lifting the elongated head 142 to provide correct engagement of the teeth 186 with the sand 228. The raked surface 232 of the sand 228 is ironed into an ironed surface 234 subsequent to the raking step.

If desired, subsequent to the raking step, the rake 140 may be inverted, not shown, so that the secondary smoothing portion 170 engages the sand 228, providing a further improved surface (not shown) to the sand 228.

While specific apparatus and method have been disclosed in the preceding description, and while part numbers have been inserted parenthetically into the claims to facilitate understanding of the claims, it should be understood that these specifics have been given for the purpose of disclosing the principles of the present invention and that many variations thereof will become apparent to those who are versed in the art. Therefore, the scope of the present invention is to be determined by the appended claims, and without any limitation by the part numbers inserted parenthetically in the claims.

INDUSTRIAL APPLICABILITY

The present invention is applicable to tools, such as rakes, and methods for attaching tool actuators, such as handles, to tool heads. In illustrated embodiments, the present invention is applicable to rakes for redistributing granular material, and for smoothing the surfaces of granular material, in response to longitudinal movement of a sand-trap rake by manually-powered or mechanically-powered movement.

What is claimed is:

1. A method for making a rake, which method comprises:

a) extruding a white-metal extrusion that includes a shaped wall, a tooth-blanking flange extending outwardly from a first portion of said shaped wall, and a handle-attaching flange extending outwardly from a second portion of said shaped wall;

b) severing an elongated head blank from said extrusion;

c) defining a plurality of rake teeth in said tooth-blanking flange of said elongated head blank; and d) attaching an elongated handle to said handle-attaching flange.

2. A method as claimed in claim 1 in which said extruding step comprises forming a lifting portion of said shaped wall proximal to said tooth-blanking flange and distal from said handle-attaching flange.

3. A method as claimed in claim 1 in which said extruding step comprises:

a) forming a lifting portion of said shaped wall, proximal to said tooth-blanking flange and distal from said handle-attaching flange, that includes a first radius of curvature; and b) forming an ironing portion of said shaped wall, proximal to said lifting portion and distal from said tooth-blanking flange, that has a smaller radius of curvature than said first radius of curvature.

4. A method as claimed in claim 1 in which said extruding step comprises:

a) forming a lifting portion of said shaped wall, proximal to said tooth-blanking flange and distal from said handle-attaching flange, that comprises a substantially planar surface;

b) forming an ironing portion of said shaped wall, proximal to said lifting portion ad distal from said tooth-blanking flange, that comprises a radius of curvature; and c) forming a secondary smoothing portion of said shaped wall proximal to said handle-attaching flange and distal from both said lifting portion and said tooth-blanking flange.

5. A method as claimed in claim 4 in which said extruding step further comprises:

a) circumscribing an opening with said shaped wall;

b) forming said tooth-blanking flange with a substantially planar surface;

c) forming said shaped and circumscribing wall, intermediate of said flanges, with a substantially planar surface that substantially coincides with said substantially planar surface of said tooth-blanking flange;

d) disposing said tooth-blanking flange substantially orthogonal to said handle-attaching flange; and e) forming said secondary smoothing portion as a substantially semi-cylindrical surface.

6. A method as claimed in claim 1 in which said attaching step comprises:

a) forming a pair of handle-clamping halves that each include a shaped clamping portion and a flange portion;

b) disposing said flange portions of said pair of handle-clamping halves toward opposite ends of said head blank;

c) enclosing a portion of said handle between pairs of said shaped clamping portions; and d) securing said handle-clamping halves to both said handle and said handle-attaching flange.

7. A method as claimed in claim 6 in which said securing step comprises:

a) slotting a portion of said handle that is proximal to an end of said handle;

b) straddling said handle-attaching flange with said slotted portion;

c) clamping both said shaped clamping portions to said slotted portion and said slotted portion to said handle-attaching flange;

d) clamping said shaped clamping portions to said handle separate from the aforesaid clamping step; and e) attaching said shaped clamping portions to said handle-attaching flange.

8. A method as claimed in claim 7 in which said method further comprises:

a) making said handle from tubing; and b) internally reinforcing said slotted portion of said handle.

9. A method as claimed in claim 7 in which said step of forming said handle-clamping halves comprises extruding.

10. A method as claimed in claim 1, which method further comprises:

a) forming a pair of handle-attaching brackets that each include a shaped clamping portion and a flange portion;

b) disposing said flange portions of said pair of handle-attaching brackets toward opposite ends of said elongated head blank;

c) placing a portion of said elongated handle between pairs of said shaped clamping portions;

d) securing said shaped clamping portions to said handle and to said handle-attaching flange; and e) separately securing each of said flange portions to said handle-attaching flange.

11. A method as claimed in claim 10 in which the first said securing step comprises:

a) slotting said portion of said handle;

b) straddling said handle-attaching flange with said slotted portion;

c) clamping both of said shaped clamping portions to said slotted portion and said slotted portion to said handle-attaching flange; and d) clamping said shaped clamping portions to said handle-attaching flange separately from the aforesaid clamping step.

12. A method as claimed in claim 11 in which said method further comprises:

a) making said handle from tubing; and b) internally reinforcing said slotted portion.

13. A method as claimed in claim 11 in which said method further comprises:

a) making said handle from tubing;

b) inserting a plug into an end of said tubing;

c) juxtaposing said plug against said end;

d) slotting a portion of said plug; and e) slotting a portion of said tubing.

14. A method as claimed in claim 13 in which said method further comprises:

a) securing said plug in said tubing prior to said slotting step;

b) performing said slotting steps subsequent to said securing step;

c) straddling said handle-attaching flange with said slotted portion of said plug; and d) clamping said slotted portion of said plug between said handle-attaching flange and said slotted portion of said tubing.

15. A method as claimed in claim 10 in which said step of forming said handle-attaching brackets with said shaped clamping portions and flange portions, comprises:

a) extruding an extrusion that includes both a continuous shaped portion and a continuous flange portion;

b) severing first and second longitudinal portions from said extrusion; and c) beveling said flange portions of said severed first and second portions.

16. A rake (140) which comprises an elongated head (142), a handle (144), and means (202) for attaching said head to said handle, the improvement which is characterized by:

said elongated head comprising a white-metal extruded head blank (148) with a shaped wall (150), a tooth-blanking flange (154) that extends outwardly from a first arcuate portion (156) of said shaped wall, a handle-attaching flange (158) that extends outwardly from a second arcuate portion (160) of said shaped wall, and a plurality of rake teeth (186) being defined in said tooth-blanking flange; and said means for attaching said head to said handle comprises a pair of handle-attaching brackets (202) each having both a shaped clamping portion (206) and a flange portion (208).

17. A rake (140) as claimed in claim 16 in which said shaped wall (150) of said head blank (148) comprises a lifting portion (162) that is disposed proximal to said tooth-blanking flange (154) and distal from said handle-attaching flange (158).

18. A rake (140) as claimed in claim 16 in which said shaped wall (150) of said head blank (148) comprises:

a lifting portion (162) of said shaped wall that is disposed proximal to said tooth-blanking flange (154), and that includes a first radius of curvature (165); and an ironing portion (166) of said shaped wall that is disposed proximal to said lifting portion and distal from said tooth-blanking flange, and that includes a smaller radius of curvature (168) than said first radius of curvature.

19. A rake (140) as claimed in claim 16 in which said shaped wall (150) of said head blank (148) comprises:

a lifting portion (162) of said shaped wall that is disposed proximal to said tooth-blanking flange (154), and that has a surface (164) that is substantially planar;

an ironing portion (166) of said shaped wall that is disposed proximal to said lifting portion and distal from said tooth-blanking flange, and that includes a radius of curvature (168); and a secondary smoothing portion (170) of said shaped wall that is disposed proximal to said handle-attaching flange (158) and distal from said lifting portion, and that comprises a substantially semi-cylindrical surface (172).

20. A rake (140) as claimed in claim 19 in which:

said shaped wall (150) circumscribes an opening (152);

said tooth-blanking flange (154) comprises a substantially planar surface (174);

said shaped and circumscribing wall (150), intermediate of said flanges (154 and 158), includes a surface (176) that is substantially planar with said substantially planar surface of said tooth-blanking flange;

said tooth-blanking flange is substantially orthogonal to said handle-attaching flange (158); and said secondary smoothing portion (170) comprises a substantially semi-cylindrical surface (172) of said shaped and circumscribing wall.

21. A rake (140) as claimed in claim 16 in which said handle (144) comprises an aluminum tube (210) having an end (212), a tubular bushing (214) fixedly inserted into said tube and juxtaposed against said end, and a slot (216) in both said aluminum tube and said tubular bushing that extends inward From said end along an axis (178), thereby providing a slotted portion (218) of said handle; and said means for attaching said head (142) to said handle comprises a first bolt (192) extending through both of said shaped clamping portions (206), through said slotted portion, and through said handle-attaching flange (158), a second bolt (204) extending through both of said shaped clamping portions and through said handle, and third and fourth bolts (190) extending through said flange portions (208) and through said handle-attaching flange.

22. A white-metal extrusion (146) for making an elongated head (142) for a rake (140), which extrusion comprises:

a shaped wall (150);

a tooth-blanking flange (154) that extends outwardly from a first arcuate portion (156) of said shaped wall;

a handle-attaching flange (158) that extends outwardly from a second arcuate portion (160) of said shaped wall;

a lifting portion (162) of said shaped wall that is disposed proximal to said tooth-blanking flange and distal from said handle-attaching flange;

an ironing portion (166) of said shaped wall that is disposed proximal to said lifting portion and distal from said tooth-blanking flange; and a secondary smoothing portion (170) of said shaped wall that is disposed proximal to said handle-attaching flange and distal from said lifting portion.

23. An extrusion (146) as claimed in claim 22 in which said shaped wall (150) circumscribes an opening (152).

24. An extrusion (146) as claimed in claim 22 in which:

said shaped wall (150) circumscribes an opening (152);

said lifting portion (162) comprises a substantially planar surface (164);

said ironing portion (166) comprises a radius of curvature (168) whose center (C2) is disposed in said circumscribed opening; and said secondary smoothing portion (170) comprises a radius of curvature (R1) whose center (C1) is disposed in said circumscribed opening.

25. A rake (140) which comprises an elongated head (142), a handle (144), and means (202) for attaching said head to said handle, the improvement which is characterized by:

means, comprising a white-metal extrusion (146), for providing a white-metal extruded blank (148) with a shaped wall (150), a tooth-blanking flange (154) that extends outwardly from a first arcuate portion (156) of said shaped wall, a handle-attaching flange (158) that extends outwardly from a second arcuate portion (160) of said shaped wall, and a plurality of rake teeth (186) being defined in said tooth-blanking flange; and said means for attaching said head to said handle includes means, comprising a pair of handle-attaching brackets (202) each having both a shaped clamping portion (206) and a flange portion (208), for clamping to both said handle and said elongated head.

* * * * *

UNITED STATES PATENT AND TRADEMARK OFFICE

CERTIFICATE OF CORRECTION

PATENT NO. : 5,605,034

DATED : 25 February 1997

INVENTOR(S) : Robert E. South et al.

It is certified that error appears in the above-indentified patent and that said Letters Patent is hereby corrected as shown below:

In column 2, "or" should be --of-- in line 36; and "bill" should be --but-- in line 52. In column 3, --, and-- should be inserted after "4" in line 66. In column 4, "44A" should be --44B-- in line 2. In column 8, "leek" should be --lock-- in line 29. In column 9, "art" should be --an-- in line 14. In Claim 4, "ad" should be --and-- in line 14.

Signed and Sealed this

Twenty-third Day of September, 1997

*Attest:*

*Attesting Officer*

Bruce Lehman

BRUCE LEHMAN

*Commissioner of Patents and Trademarks*